US011396755B2

(12) United States Patent
Winter

(10) Patent No.: US 11,396,755 B2
(45) Date of Patent: Jul. 26, 2022

(54) HANDRAIL SYSTEM FOR RAMP ASSEMBLY AND HANDRAIL ADAPTOR HAVING ANGLED INTERFACE

(71) Applicant: Homecare Products, Inc., Algona, WA (US)

(72) Inventor: Ronald S. Winter, Pacific, WA (US)

(73) Assignee: Homecare Products, Inc., Algona, WA (US)

( * ) Notice: Subject to any disclaimer, the term of this patent is extended or adjusted under 35 U.S.C. 154(b) by 947 days.

(21) Appl. No.: 16/167,975

(22) Filed: Oct. 23, 2018

(65) Prior Publication Data

US 2019/0119923 A1 Apr. 25, 2019

Related U.S. Application Data

(60) Provisional application No. 62/575,930, filed on Oct. 23, 2017.

(51) Int. Cl.
*E04F 11/18* (2006.01)
*E04F 11/00* (2006.01)

(52) U.S. Cl.
CPC ..... *E04F 11/1808* (2013.01); *E04F 11/002* (2013.01); *E04F 2011/005* (2013.01); *E04F 2011/007* (2013.01); *E04F 2011/1819* (2013.01); *E04F 2011/1876* (2013.01); *E04F 2011/1889* (2013.01); *E04F 2011/1897* (2013.01)

(58) Field of Classification Search
CPC . E04F 11/18; E04F 11/1836; E04F 2011/005; E04F 2011/007; E04F 2011/1819; E04F 2011/1821; E04F 2011/1885; E04F 2011/1889; E04F 11/00; E04F 11/002; E04H 17/1447; E04H 17/1448; E04H 17/1452; E04H 17/1488
USPC ..... 256/65.02, 65.03, 65.08
See application file for complete search history.

(56) References Cited

U.S. PATENT DOCUMENTS 2,560,014 A * 7/1951 Wadsworth ..... E04H 17/003 256/22
2,647,000 A * 7/1953 Colley ..... F16B 7/0453 403/237
6,308,937 B1 * 10/2001 Pettit ..... E04F 11/181 256/65.05

(Continued)

FOREIGN PATENT DOCUMENTS

CA 2631426 A1 * 11/2009 ..... E04F 11/1834
DE 9305699 U1 * 6/1993 ..... E04F 11/1817

(Continued)

*Primary Examiner* — Jonathan P Masinick
(74) *Attorney, Agent, or Firm* — Polsinelli PC

(57) ABSTRACT

In one embodiment of the present disclosure, a handrail system for a ramp assembly, the handrail system includes first and second handrail posts oriented substantially perpendicular to a ground surface, a handrail portion having first and second ends extending between the first and second handrail posts, wherein the handrail portion is substantially parallel to a ramping surface ramping from a first elevation to a second elevation at a grade, and first and second interfaces at the first and second ends of the handrail portion for interfacing with the first and second handrail posts. In another embodiment of the present disclosure, an adaptor is configured for a handrail portion.

9 Claims, 7 Drawing Sheets

(56) References Cited

U.S. PATENT DOCUMENTS 6,526,614 B2 * 3/2003 Anderson ..... E01C 9/083 14/69.5
6,964,410 B1 * 11/2005 Hansen ..... E04F 11/1812 256/24
7,125,002 B2 * 10/2006 Platt ..... E04H 17/1417 256/65.04
7,448,820 B1 * 11/2008 Faber ..... F16B 7/0453 403/240
7,540,472 B2 * 6/2009 Striebel ..... E04F 11/1834 256/67
7,607,186 B1 * 10/2009 Mitchell ..... E04F 11/002 14/69.5
8,844,084 B2 * 9/2014 Allen ..... E01D 15/12 14/69.5
9,376,819 B2 * 6/2016 Suggate ..... E04F 11/002
9,631,371 B2 * 4/2017 Suggate ..... E04F 11/002
9,637,932 B2 * 5/2017 Schneider ..... E04F 11/1834
9,732,528 B1 * 8/2017 Kuo ..... E04F 11/002
9,790,689 B2 * 10/2017 Milanowski ..... E04F 11/1842
10,676,937 B2 * 6/2020 Winter ..... E04F 11/02
2007/0257245 A1 * 11/2007 Patterson ..... E04F 11/1817 256/65.07
2009/0255066 A1 * 10/2009 Brock ..... E04F 11/002 14/69.5
2011/0073824 A1 * 3/2011 Lappin ..... E04F 11/1817 256/65.08

FOREIGN PATENT DOCUMENTS

GB 2375579 A * 11/2002 ..... E04F 11/1836
KR 20070009521 A * 1/2007
KR 100883313 B1 * 2/2009
KR 20140023061 A * 2/2014
WO WO-03035997 A1 * 5/2003 ..... F16B 7/048

* cited by examiner

HANDRAIL SYSTEM FOR RAMP ASSEMBLY AND HANDRAIL ADAPTOR HAVING ANGLED INTERFACE

CROSS-REFERENCE TO RELATED APPLICATION

This application claims the benefit of U.S. Provisional Application No. 62/575,930 filed Oct. 23, 2017, the disclosure of which is hereby expressly incorporated by reference herein in its entirety.

BACKGROUND

Ramps and platforms are becoming increasingly common, due primarily to the recent passage of the Americans with Disabilities Act (ADA) requiring public buildings to be designed or modified to provide wheel chair access. These ramps and platforms assist those people confined to wheelchairs or who use walkers by providing a suitable pathway or rampway to the entrances of public and private buildings and stores, which may be at elevations above or below ground level. Since each site may be generally different from other sites, there is a need for ramp and platform assemblies that are modular in construction, and designed to minimize the cost and assembly time of at-site assembly.

Modular ramp and platform assemblies generally include deck surfaces, support posts, and handrails. These modular assemblies can be configured to provide ramping and horizontal deck surfaces to provide access, for example, if a user needs to travel from elevation A to elevation B, but is not able to traverse stairs or a steep slope to get there.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a handrail system for a ramp assembly is provided. The handrail system includes first and second handrail posts oriented substantially perpendicular to a ground surface; a handrail portion having first and second ends extending between the first and second handrail posts, wherein the handrail portion is substantially parallel to a ramping surface ramping from a first elevation to a second elevation at a grade; and first and second interfaces at the first and second ends of the handrail portion for interfacing with the first and second handrail posts.

In accordance with another embodiment of the present disclosure, an adaptor for a handrail portion configured to extend between first and second handrail posts oriented substantially perpendicular to a ground surface is provided. The handrail portion has first and second ends configured to extend between the first and second handrail posts, wherein the handrail portion is substantially parallel to a ramping surface ramping from a first elevation to a second elevation at a grade and the handrail portion including an inner bore. The adaptor includes a body for being received with the inner bore of the first end of the handrail portion; an outer surface extending from the body configured to interface with one of the first and second handrail posts; and a nutsert disposed in the body of the adaptor for receiving a fastener for attachment of the first end of the handrail portion to one of the first and second handrail posts, wherein the nutsert is configured to receive a fastener that is non-parallel to a longitudinal axis of the handrail portion.

In accordance with any of the embodiments described herein, the first and second interfaces may be configured at an angle relating to the grade of the ramping surface.

In accordance with any of the embodiments described herein, each of the first and second interfaces may include a nutsert for receiving a fastener for attachment of the handrail portion to each of the first and second handrail posts.

In accordance with any of the embodiments described herein, the nutsert may be configured to receive a fastener that is non-parallel to a longitudinal axis of the handrail portion.

In accordance with any of the embodiments described herein, the first and second interfaces may be coupled to the first and second ends of the handrail portion.

In accordance with any of the embodiments described herein, the first and second interfaces may be received within the first and second ends of the handrail portion.

In accordance with any of the embodiments described herein, the first and second interfaces may include first alignment members for aligning with corresponding second alignment members at the first and second ends of the handrail portion.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following description sets forth one or more examples of a ramp and/or platform assembly and components thereof. Generally, embodiments described herein relate to modular ramp and platform assemblies that may include deck surfaces, support posts, and handrails. Additional embodiments relate to interfaces between components of the platform assembly, including, for example, the interface between the ramp section and the deck or platform section, the interface between the platform support posts and the handrail posts, etc.

As described in greater detail below, many of the components of the ramp and platform assembly may be formed from metal, for example, from extruded aluminum. Extruded aluminum construction generally reduces parts in the overall system, thereby reducing manufacturing and assembly costs, as well as operational noise generated by rattling part couplings. Moreover, extruded aluminum parts can be designed to achieve the same strength and stiffness requirements as steel construction, while having reduced weight over steel parts or parts made from other materials, allowing for improved ease of assembly and optimized part design.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. It will be appreciated that embodiments of the present disclosure may employ any combination of features described herein.

Figure 1:
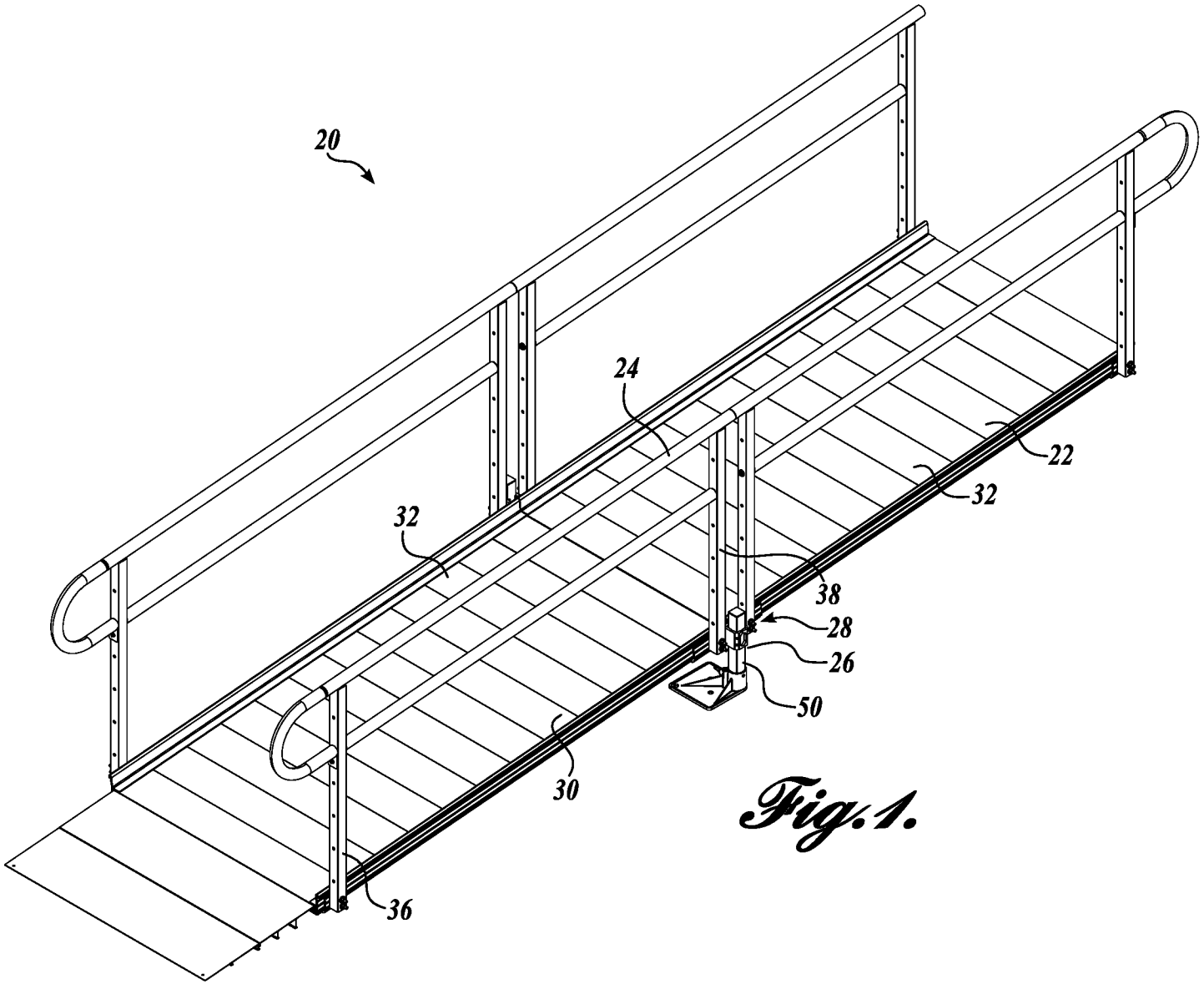
FIG. 1 is an isometric view of a ramp assembly in accordance with one embodiment of the present disclosure.

FIG. 1 illustrates an example of a ramp assembly, generally designated 20, formed in accordance with aspects of the present disclosure. In the embodiment shown in FIG. 1, the ramp assembly 20 includes a decking system 22, a handrail system 24 configured to couple with the decking system 22, a support system 26 configured to couple with the decking system 22, and an interface 28 between the handrail system 24, the support system 26, and the decking system 22.

In accordance with ADA requirements, the grade of the ramp must be within a certain rise to run ratio. Such ratio may vary for ramping deck surfaces depending on the rise and the distance between the desired high and low elevation points of the ramp. Therefore, interfaces in the handrail system are needed to properly align the handrail system 24 with the decking system 22.

Figure 2:
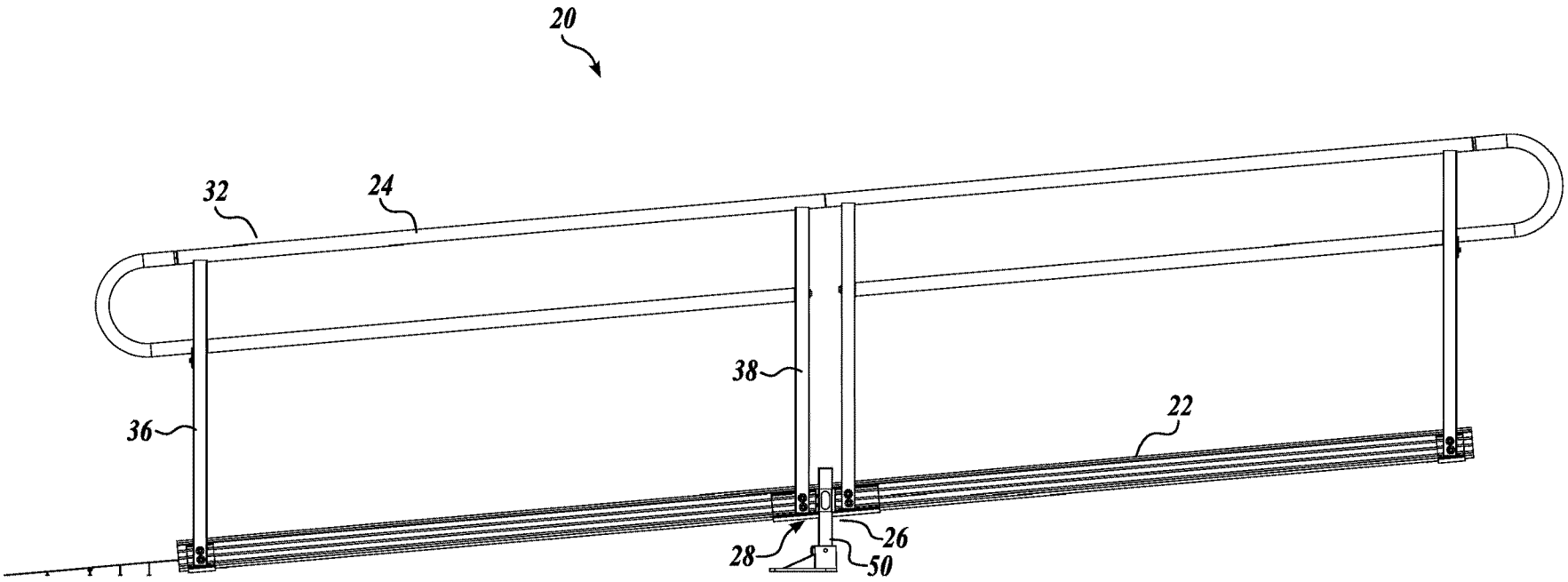
FIG. 2 is side view of the ramp assembly of FIG. 1.
Figure 3:
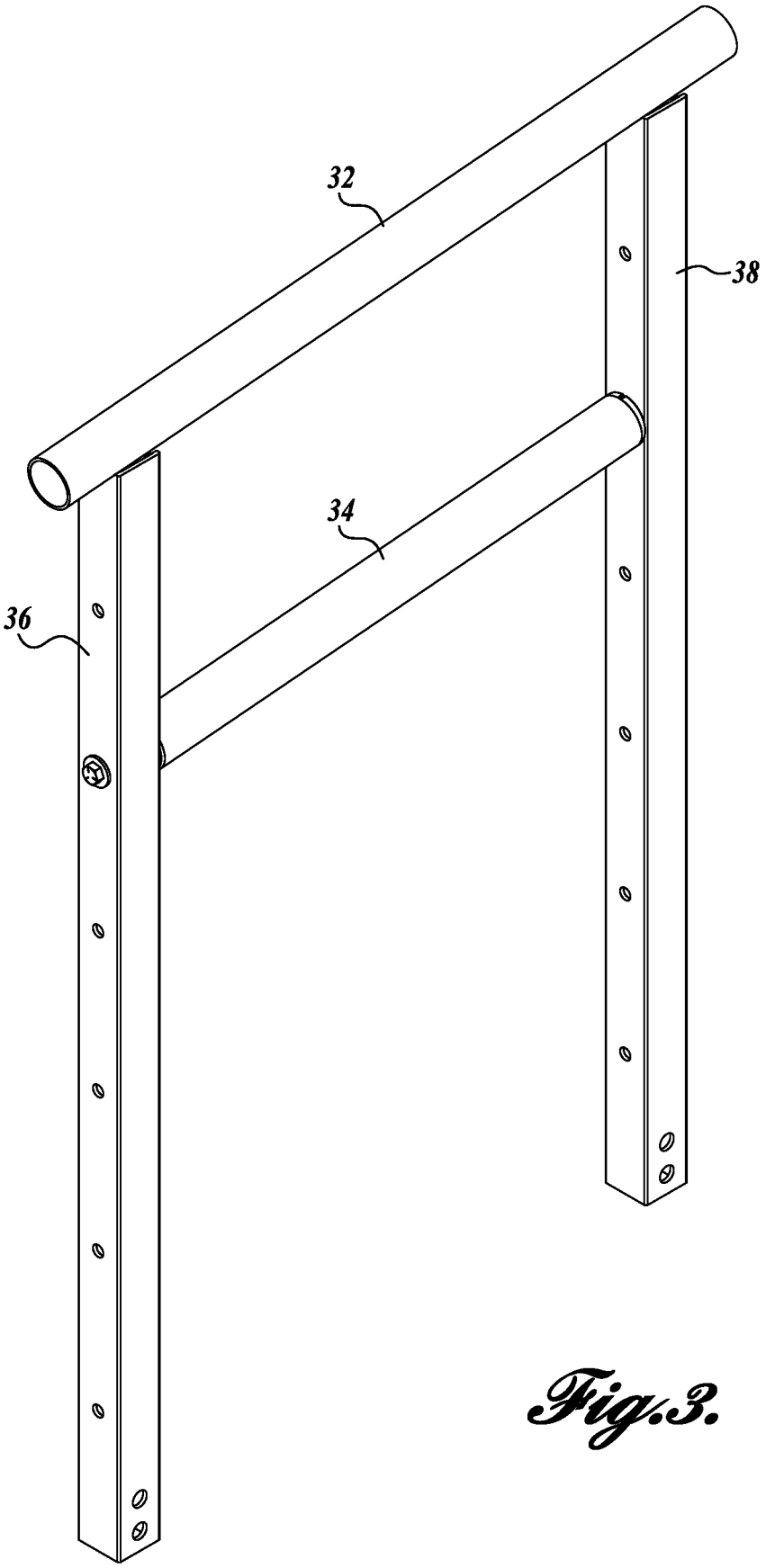
FIG. 3 is an isometric view of a handrail system of the ramp assembly of FIG. 1.
Figure 4:
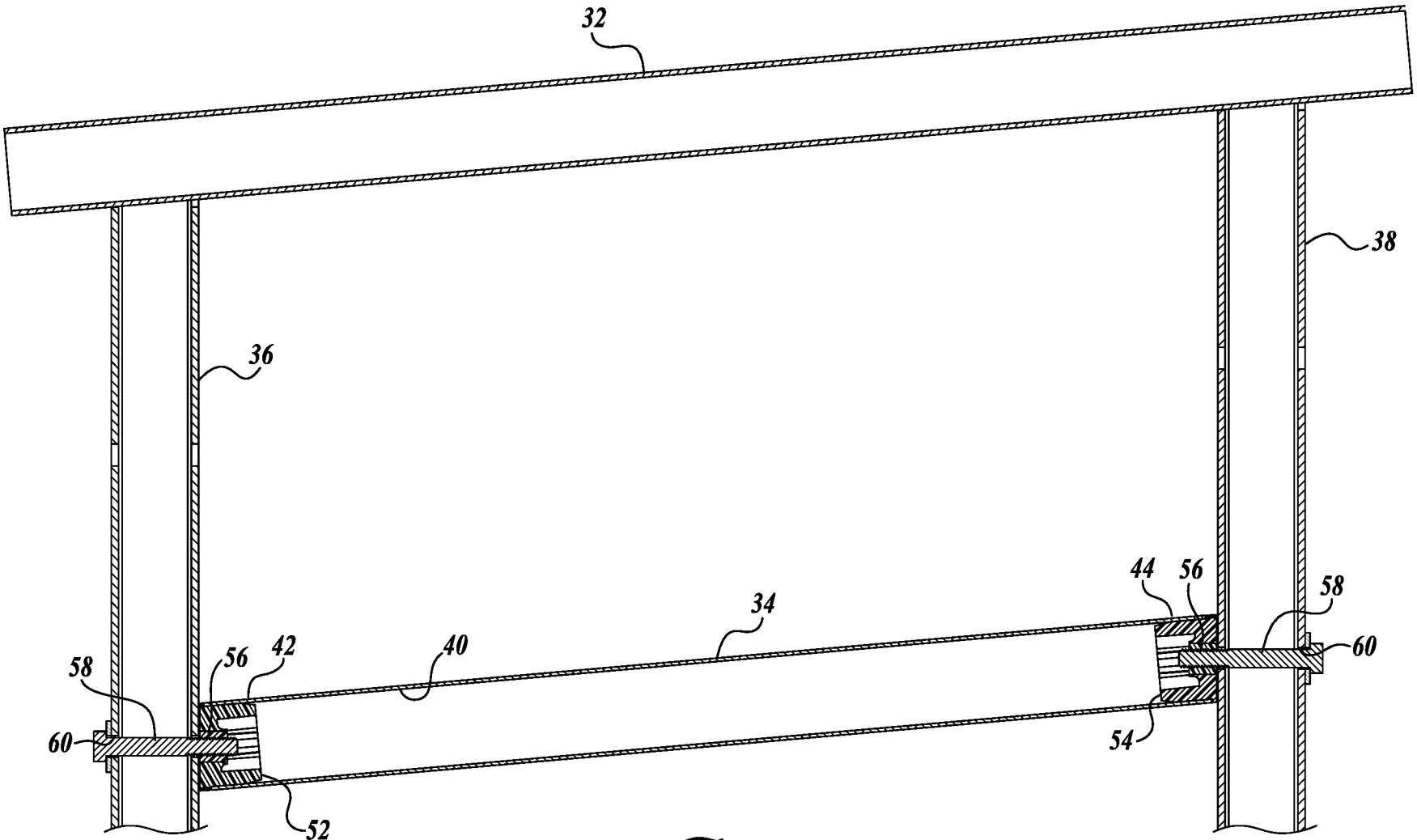
FIG. 4 is a cross-sectional, partial side view of the handrail system of FIG. 3.

Referring to FIGS. 1 and 2, the handrail system 24 includes upper and lower handrail portions 32 and 34 coupled to handrail posts 36 and 38. The lower handrail portion 34 extends between the handrail posts 36 and 38, coupling at each end to each post 36 and 38.

As seen in FIG. 2, the upper and lower handrail portions 32 and 34 of the handrail system 24 generally incline at the same grade as the decking system 22 for the user to have consistence handrail positioning as the user traverses the decking system 22 of the ramp assembly 20. However, the handrail posts 36 and 38 are generally positioned parallel to the legs 50 of the support system 26 of the ramp assembly 20 and perpendicular to a ground surface. Therefore, in accordance with one embodiment of the present disclosure, the lower handrail portion 34 includes an angled interface for coupling with the handrail posts 36 and 38.

In one embodiment of the present disclosure, the lower handrail portion 34 may have an angled interface to enable a 5 degree grade from the first handrail post 36 and to the second handrail post 38. Other angled interfaces are also within the scope of the present disclosure. For example, the angled interface may enable a grade in the range of 2 to 8 degrees from the first handrail post 36 and to the second handrail post 38.

Figure 5:
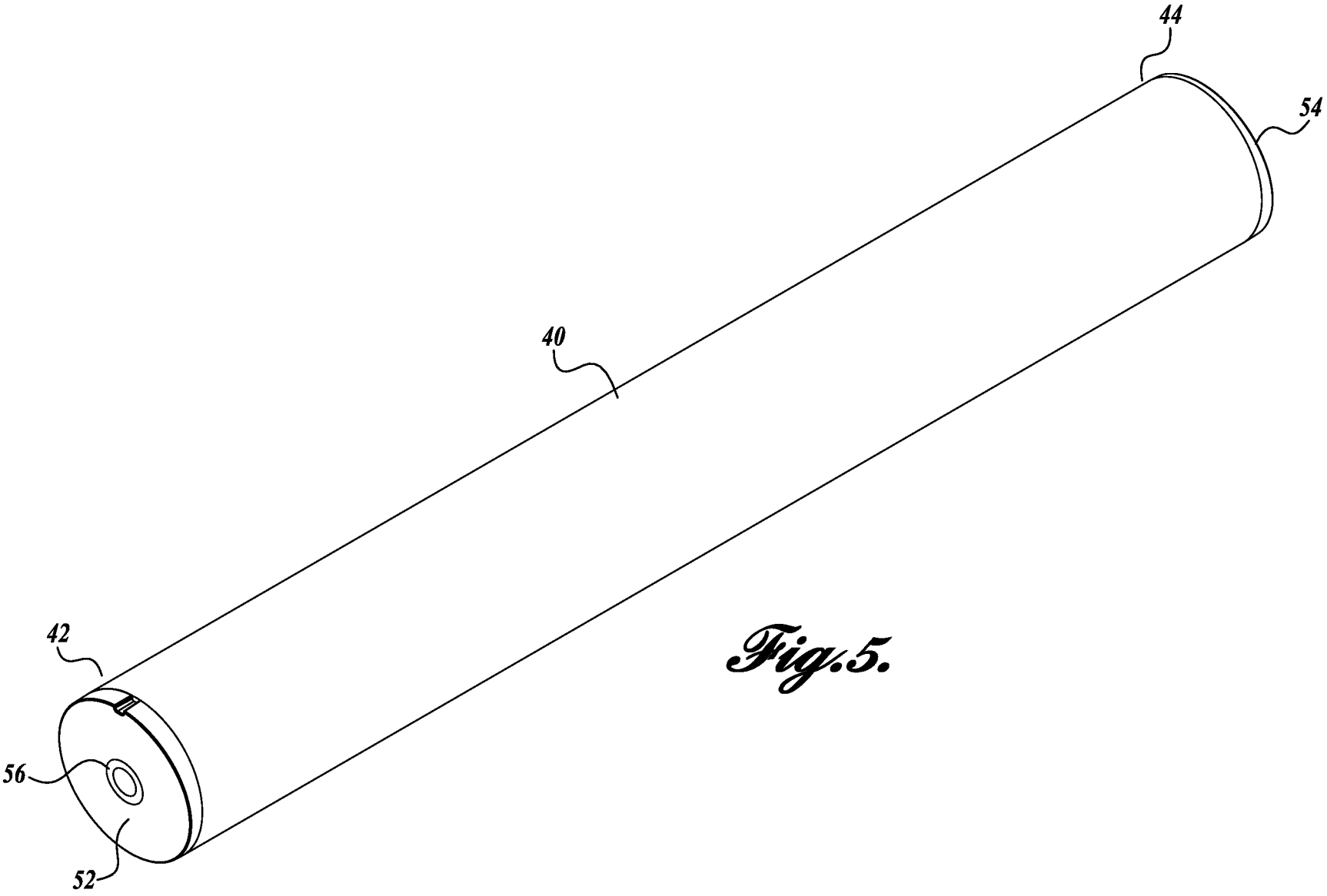
FIG. 5 is an isometric view of a handrail post joiner of the handrail system of FIG. 3.
Figure 6:
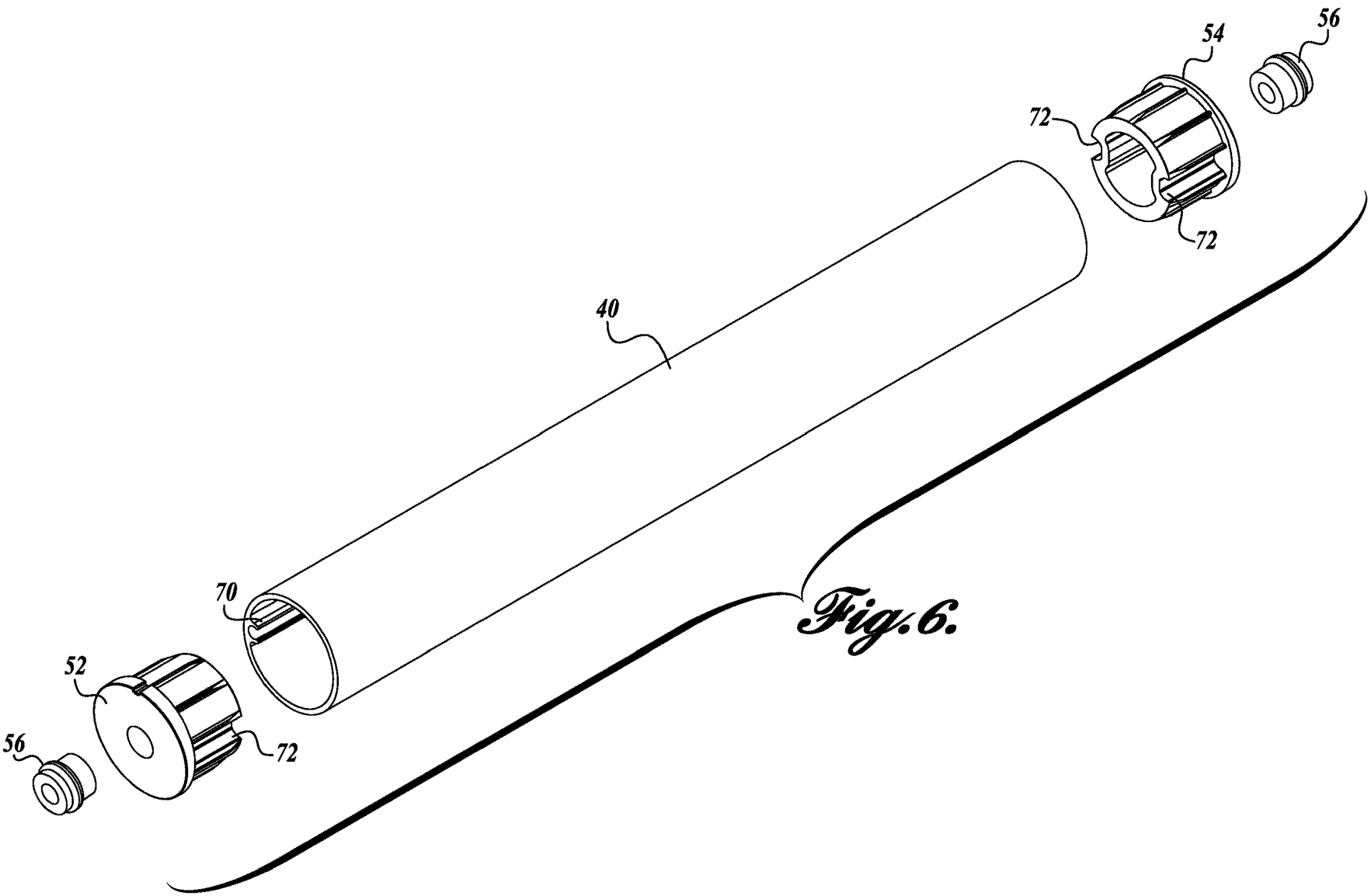
FIG. 6 is an exploded view of the handrail post joiner of FIG. 5.
Figure 7:
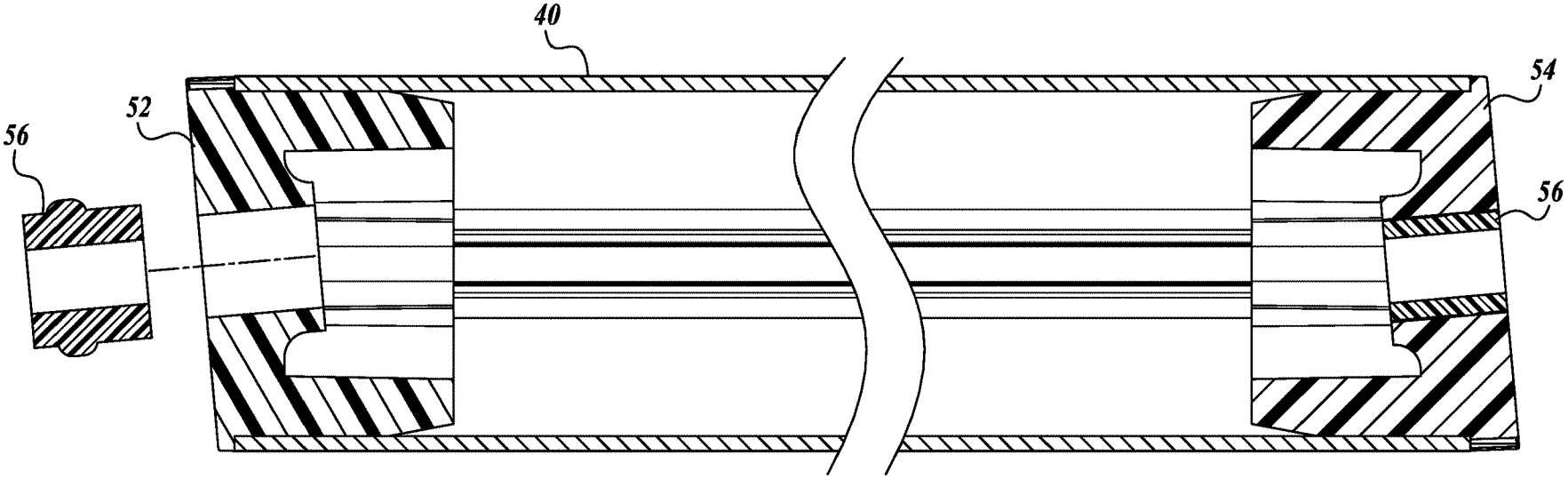
FIG. 7 is a cross-sectional, partial side view of the handrail post joiner of FIG. 5.

Referring to FIGS. 5-7, the lower handrail portion 34 includes a tubular section 40 having first and second ends 42 and 44. First and second end portions 52 and 54 can be inserted into or otherwise attached to the ends 42 and 44 of the tubular section 40. In one embodiment, the first and second end portions 52 and 54 are adaptors. Each of the first and second end portions 52 and 54 includes a nutsert 56 for coupling with a fastener 58, which is received through holes 60 the first and second handrail posts 36 and 38.

While the nutserts 56 may be centrally located in the respective ends 42 and 44 of the tubular section 40, the nutsert 56 is offset from the longitudinal axis of the tubular section 40 by the desired angled interface. For example, the nutsert 56 may be offset from the longitudinal axis of the tubular section 40 by a certain angle to receive a fastener at an angle relative to the longitudinal axis of the tubular section 40.

In the illustrated embodiment, the tubular section 40 generally has a circular cross-section. However, other cross-sectional shapes of the tubular section and the corresponding inserts are within the scope of the present disclosure. For example, the tubular cross-sectional shape may be rectangular or polygonal.

In the illustrated embodiment, the first and second end portions 52 and 54 are inserted into the tubular portion 40, which is a tubular portion having a circular cross-section shape. A first alignment portion 70 is configured in the tubular portion 40 to mate with a second alignment portion 72 in the first and second ends portions 52 and 54 to prevent the first and second end portions 52 and 54 from spinning in the tubular portion 40 when a fastener 60 is being inserted into the nutsert 56.

In the illustrated embodiment, the handrail posts 36 and 38 have a rectangular cross-section to provide a planar face to which the first and second end portions 52 and 54 of the lower handrail portion 34 attach. However, it should be appreciate other cross-sectional shapes of the handrail posts 36 and 38 and the corresponding first and second end portions 52 and 54 are within the scope of the present disclosure. For example, the tubular cross-sectional shape may be rectangular or polygonal, and the corresponding first and second end portions 52 and 54 may be designed and configured for interfacing with a non-planar face on the handrail posts 36 and 38.

In accordance with embodiments of the present disclosure, the tubular section 40 may be manufactured from suitable metal or plastic materials. Likewise, the first and second ends portions 52 and 54 designed to attach to the ends 42 and 44 of the tubular section 40 may be manufactured from suitable metal or plastic materials. In one embodiment, the tubular section 40 may be metal, such as extruded aluminum, and the first and second ends portions 52 and 54 may be plastic to provide some elasticity when inserted into the ends 42 and 44 of the tubular section 40.

In previous designs, the nutsert was configured to receive a fastener along a longitudinal axis of the tubular section of the lower handrail portion. When the lower handrail portion was connected between upright handrail posts (generally perpendicular to a ground surface), the threads of the nutsert could become stripped as a result of the angle of the fastener. Even if the threads did not become stripped, there would likely be some play between the coupling between the lower handrail portion and the upright handrail posts, creating a loose and rattling connection. Therefore, advantages of embodiments of the present disclosure include less risk of stripping fastener threads and a more reliable and secure attachment of handrail portions to handrail posts in ramp assemblies.

While illustrative embodiments have been illustrated and described, it will be appreciated that various changes can be made therein without departing from the spirit and scope of the invention.

The embodiments of the invention in which an exclusive property or privilege is claimed are defined as follows:

1. A handrail system for a ramp assembly, the handrail system comprising:

first and second handrail posts oriented substantially perpendicular to a ground surface;

a handrail portion having first and second ends extending between the first and second handrail posts, wherein the handrail portion is substantially parallel to a ramping surface ramping from a first elevation to a second elevation at a grade;

first and second interfaces at the first and second ends of the handrail portion for interfacing with the first and second handrail posts, wherein each of the first and second interfaces comprises:

an adaptor body couplable to one of the first and second ends of the handrail portion;

a rivet nut opening defined in the adaptor body that extends within the adaptor body along a rivet nut opening axis offset from a longitudinal axis of the adaptor body; and a rivet nut receivable within the rivet nut opening, the rivet nut configured for threadably receiving a fastener for attachment of the handrail portion to one of the first and second handrail posts.

2. The handrail system of claim 1, wherein the first and second interfaces are configured at an angle relating to the grade of the ramping surface.

3. The handrail system of claim 1, wherein the rivet nut is configured to receive a fastener that is non-parallel to a longitudinal axis of the handrail portion.

4. The handrail system of claim 1, wherein the adaptor body of the first and second interfaces are coupled to the first and second ends of the handrail portion.

5. The handrail system of claim 1, wherein the adaptor body of the first and second interfaces are received within the first and second ends of the handrail portion.

6. The handrail system of claim 5, wherein the first and second interfaces include an end portion that protrudes from the handrail portion when the adaptor body is received within one of the first and second ends of the handrail portion, wherein the end portion defines an end surface, and wherein an angle is defined between the end surface of the end portion and an end surface of the handrail portion.

7. The handrail system of claim 1, wherein the adaptor body of the first and second interfaces include first alignment members for aligning with corresponding second alignment members at the first and second ends of the handrail portion.

8. An adaptor for a handrail portion configured to extend between first and second handrail posts oriented substantially perpendicular to a ground surface, the handrail portion having first and second ends configured to extend between the first and second handrail posts, wherein the handrail portion is substantially parallel to a ramping surface ramping from a first elevation to a second elevation at a grade and the handrail portion including an inner bore, the adaptor comprising:

a body for being received with the inner bore of the first end of the handrail portion;

an outer surface extending from the body configured to interface with one of the first and second handrail posts;

a rivet nut opening defined in the body that extends within the body along a rivet nut opening axis offset from a longitudinal axis of the body; and a rivet nut disposed in the rivet nut opening, the rivet nut configured for threadably receiving a fastener for attachment of the first end of the handrail portion to one of the first and second handrail posts, wherein the rivet nut is configured to receive a fastener that is non-parallel to a longitudinal axis of the handrail portion.

9. The adaptor of claim 8, further comprising an end portion that protrudes from the handrail portion when the body is received within the inner bore of the first end of the handrail portion, wherein the end portion defines an end surface, and wherein an angle is defined between the end surface of the end portion and an end surface of the first end of the handrail portion.

* * * * *